US011742576B2

(12) United States Patent
Su et al.

(10) Patent No.: US 11,742,576 B2
(45) Date of Patent: Aug. 29, 2023

(54) TUNABLE ANTENNA MODULE

(71) Applicant: Wistron NeWeb Corp., Hsinchu (TW)

(72) Inventors: Tse Su, Hsinchu (TW); Chung-Yen Hsiao, Hsinchu (TW); Huang-Tse Peng, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 222 days.

(21) Appl. No.: 17/101,624

(22) Filed: Nov. 23, 2020

(65) Prior Publication Data

US 2021/0257734 A1 Aug. 19, 2021

(30) Foreign Application Priority Data

Feb. 18, 2020 (TW) ..... 109105113

(51) Int. Cl.
*H01Q 5/328* (2015.01)
*H01Q 1/24* (2006.01)
*H01Q 1/48* (2006.01)

(52) U.S. Cl.
CPC ..... *H01Q 5/328* (2015.01); *H01Q 1/243* (2013.01); *H01Q 1/48* (2013.01)

(58) Field of Classification Search
CPC ..... H01Q 5/328; H01Q 1/38; H01Q 5/371; H01Q 9/145; H01Q 5/335; H01Q 5/378; H01Q 1/243; H01Q 9/0442; H01Q 9/42
See application file for complete search history.

(56) References Cited

U.S. PATENT DOCUMENTS

| | | | | |
|---|---|---|---|---|
| 7,330,155 | B2 * | 2/2008 | Chan | H01Q 9/0421 343/702 |
| 8,957,827 | B1 * | 2/2015 | Lee | H01Q 5/378 343/702 |
| 9,077,066 | B1 * | 7/2015 | Lee | H01Q 9/0407 |
| 9,431,717 | B1 * | 8/2016 | Lee | H01Q 1/243 |
| 9,992,312 | B1 * | 6/2018 | Deng | H04Q 1/24 |
| 10,797,379 | B1 * | 10/2020 | Lee | H01Q 9/42 |

(Continued)

FOREIGN PATENT DOCUMENTS

| | | | |
|---|---|---|---|
| CN | 1893182 | B | 11/2011 |
| TW | M452477 | U | 5/2013 |

(Continued)

*Primary Examiner* — Ricardo I Magallanes
(74) *Attorney, Agent, or Firm* — McClure, Qualey & Rodack, LLP

(57) ABSTRACT

A tunable antenna module includes a ground metal plane, a nonconductive support element, a first radiation metal element, a second radiation metal element, a switch element, and a plurality of impedance elements. The ground metal plane provides a ground voltage. The first radiation metal element is coupled to a signal source. The second radiation metal element is adjacent to and separate from the first radiation metal element. The switch element selects one of the impedance elements, such that the second radiation metal element is coupled through the selected impedance element to the ground voltage. The nonconductive support element has a 3D (Three-Dimensional) structure. The first radiation metal element and the second radiation metal element are distributed over the nonconductive support element.

15 Claims, 5 Drawing Sheets

(56) References Cited

U.S. PATENT DOCUMENTS

2010/0013713 A1* 1/2010 Peng ..... H01Q 9/0421 343/700 MS
2014/0057578 A1* 2/2014 Chan ..... H04B 1/18 455/73
2014/0104134 A1* 4/2014 Chen ..... H01Q 9/145 343/876
2014/0253398 A1* 9/2014 Hsieh ..... H01Q 5/335 343/745
2014/0354506 A1* 12/2014 Lai ..... H01Q 5/371 343/893
2015/0022422 A1* 1/2015 Chang ..... H01Q 1/243 343/861
2015/0061960 A1* 3/2015 Liou ..... H01Q 5/335 343/861
2015/0123874 A1* 5/2015 Chan ..... H01Q 5/30 343/905
2015/0155632 A1* 6/2015 Lai ..... H01Q 1/243 343/700 MS
2015/0180124 A1* 6/2015 Chen ..... H01Q 5/335 343/745
2015/0333390 A1* 11/2015 Peng ..... H01Q 5/378 343/702
2016/0134017 A1* 5/2016 Lin ..... H01Q 5/335 343/861
2017/0012357 A1* 1/2017 Zhang ..... H01Q 5/328
2017/0040668 A1* 2/2017 Ayala Vazquez .... H01Q 13/106
2017/0054220 A1* 2/2017 Jenwatanavet ..... H01Q 9/42
2018/0062270 A1* 3/2018 Liang ..... H01Q 9/42
2019/0027833 A1* 1/2019 Ayala Vazquez ..... H01Q 1/243
2019/0131693 A1* 5/2019 Lee ..... H01Q 1/243
2020/0185831 A1* 6/2020 Chen ..... H01Q 9/30
2021/0351509 A1* 11/2021 Lin ..... H01Q 5/328

FOREIGN PATENT DOCUMENTS

TW I523319 B 2/2016
TW I641183 B 11/2018

* cited by examiner

220 { E1, E2, E3, E4, E5, E6 }

230 { 234, 235 }

240 { 244, 245, 246 }

TUNABLE ANTENNA MODULE

CROSS REFERENCE TO RELATED APPLICATIONS

This application claims priority of Taiwan Patent Application No. 109105113 filed on Feb. 18, 2020, the entirety of which is incorporated by reference herein.

BACKGROUND OF THE INVENTION

Field of the Invention

The disclosure generally relates to a tunable antenna module, and more particularly, it relates to a tunable antenna module for covering wideband operations.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, the communication quality of the mobile device will suffer. Accordingly, it has become a critical challenge for antenna designers to design a small-size and wideband antenna module.

Based on current LTE base stations, it is a mainstream technology status of LPWAN (Low-Power Wide-Area Network) to upgrade to LTE-M/NB-IoT (Narrowband Internet of Things) using In-Band mechanisms. Furthermore, LTE-M/NB-IoT implements fast network deployments with highly-secure licensed spectrums. In the future, LTE-M/NB-IoT will also support access to 5G core networks, and can coexist on 5G NR (New Radio) operation frequency bands. Thus, LTE-M/NB-IoT will play a more important role in the 5G generation.

BRIEF SUMMARY OF THE INVENTION

In an exemplary embodiment, the disclosure is directed to a tunable antenna module that includes a ground metal plane, a nonconductive support element, a first radiation metal element, a second radiation metal element, a switch element, and a plurality of impedance elements. The ground metal plane provides a ground voltage. The first radiation metal element is coupled to a signal source. The second radiation metal element is adjacent to but separate from the first radiation metal element. The switch element selects one of the impedance elements, and the second radiation metal element is coupled through the selected impedance element to the ground voltage. The nonconductive support element has a 3D (Three-Dimensional) structure. The first radiation metal element and the second radiation metal element are distributed over the nonconductive support element.

In some embodiments, the nonconductive support element substantially has a cuboid shape with a first surface, a second surface, a third surface, a fourth surface, a fifth surface, and a sixth surface. The first surface is opposite to the second surface. The second surface is adjacent to the ground metal plane. The third surface, the fourth surface, the fifth surface, and the sixth surface are positioned between the first surface and the second surface.

In some embodiments, the first radiation metal element includes a first coupling portion and a first connection portion. The first coupling portion is coupled through the first connection portion to the signal source.

In some embodiments, the first coupling portion of the first radiation metal element substantially has a straight-line shape, and is disposed on the first surface of the nonconductive support element.

In some embodiments, the first connection portion of the first radiation metal element substantially has a U-shape, and is disposed on the third surface of the nonconductive support element.

In some embodiments, the second radiation metal element includes a second coupling portion, a second connection portion, and a meandering portion. The second coupling portion is coupled through the second connection portion and the meandering portion to the switch element.

In some embodiments, the second coupling portion of the second radiation metal element substantially has an L-shape, and is disposed on the first surface of the nonconductive support element.

In some embodiments, the second connection portion of the second radiation metal element substantially has a rectangular shape, and is disposed on the fourth surface of the nonconductive support element.

In some embodiments, the second connection portion of the second radiation metal element almost covers the whole fourth surface of the nonconductive support element.

In some embodiments, the fourth surface of the nonconductive support element is arranged toward an exterior side or an air side.

In some embodiments, the meandering portion of the second radiation metal element substantially has an S-shape, and is disposed on the fifth surface of the nonconductive support element.

In some embodiments, a coupling gap is formed between the first coupling portion of the first radiation metal element and the second coupling portion of the second radiation metal element. The width of the coupling gap is less than or equal to 3 mm.

In some embodiments, the tunable antenna module covers a first frequency band from 699 MHz to 894 MHz, a second frequency band around 1575 MHz, and a third frequency band from 1710 MHz to 2155 MHz. The length of the first radiation metal element is shorter than or equal to 0.25 wavelength of the second frequency band. The length of the second radiation metal element is shorter than or equal to 0.25 wavelength of the lowest frequency of the first frequency band.

In some embodiments, the impedance elements includes a first impedance element, a second impedance element, a third impedance element, and a fourth impedance element. Each of the first impedance element, the second impedance element, and the third impedance element is a capacitor. The fourth impedance element is a resistor.

In some embodiments, the tunable antenna module further includes a fifth impedance element, a sixth impedance element, and a seventh impedance element. The fifth impedance element is coupled between a first node and the ground voltage. The first node is further coupled to the signal source. The sixth impedance element is coupled between a second node and the ground voltage. The second node is further coupled to the first connection portion of the first radiation metal element. The seventh impedance element is coupled between the first node and the second node.

In some embodiments, each of the fifth impedance element and the sixth impedance element is a capacitor. The seventh impedance element is a short-circuited path or an inductor.

In some embodiments, the tunable antenna module further includes an eighth impedance element and a ninth impedance element. The eighth impedance element is coupled between a third node and a fourth node. The third node is further coupled to the meandering portion of the second radiation metal element. The ninth impedance element is coupled between the fourth node and the ground voltage. The fourth node is further coupled to the switch element.

In some embodiments, any of the eighth impedance element and the ninth impedance element is a short-circuited path, a capacitor, or an inductor.

In some embodiments, there is no clearance region designed on the ground metal plane.

In some embodiments, the total height of the nonconductive support element on the ground metal plane is at least 9 mm.

With the development of the commercial applications of the wide area mobile IoT (Internet of Things), the invention combines a switch element and proposes a wideband tunable antenna module without any clearance region, in order to meet the requirements of widely-used frequency bands for telecommunication and miniature antenna sizes.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
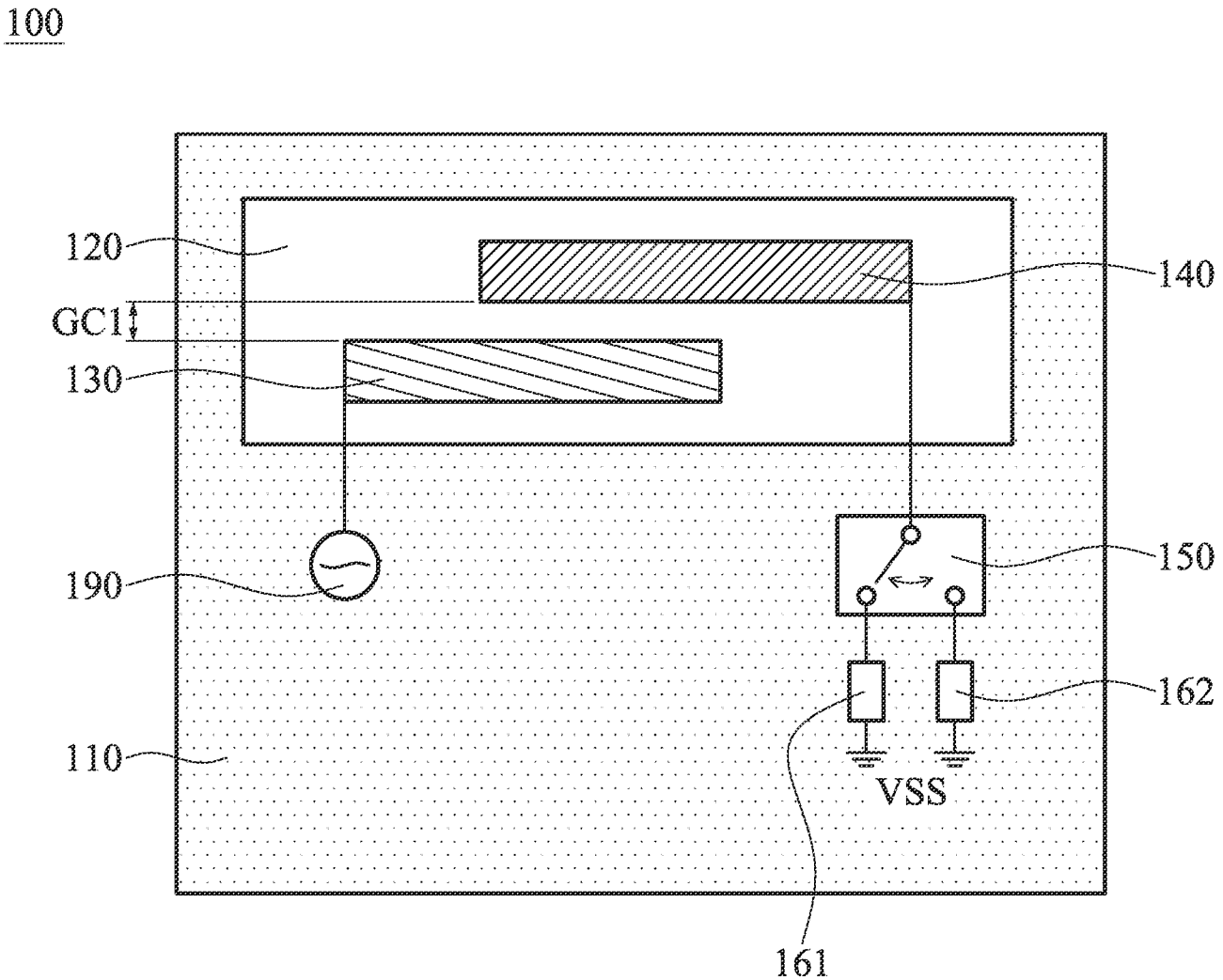
FIG. 1 is a diagram of a tunable antenna module according to an embodiment of the invention.

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a diagram of a tunable antenna module 100 according to an embodiment of the invention. For example, the tunable antenna module 100 may be applied to IoT (Internet of Things). As shown in FIG. 1, the tunable antenna module 100 at least includes a ground metal plane 110, a nonconductive support element 120, a first radiation metal element 130, a second radiation metal element 140, a switch element 150, and a plurality of impedance elements 161 and 162. It should be understood that the tunable antenna module 100 may further include other components, such as a processor, a power supply module and/or a housing, although they are not displayed in FIG. 1.

The ground metal plane 110 can provide a ground voltage VSS. The nonconductive support element 120 may be disposed on the ground metal plane 110. That is, the entire vertical projection of the nonconductive support element 120 may be inside the ground metal plane 110. The nonconductive support element 120 has a 3D (Three-Dimensional) structure. The first radiation metal element 130 and the second radiation metal element 140 are distributed over surfaces of the nonconductive support element 120. The first radiation metal element 130 is coupled to a signal source 190. For example, the signal source 190 may be an RF (Radio Frequency) module for exciting the tunable antenna module 100. The second radiation metal element 140 is adjacent to the first radiation metal element 130. The second radiation metal element 140 is completely separate from the first radiation metal element 130. A coupling gap GC1 may be formed between the first radiation metal element 130 and the second radiation metal element 140, such that the second radiation metal element 140 can be excited by the first radiation metal element 130 using a coupling mechanism. The impedance elements 161 and 162 have different impedance values. The total number of impedance elements is not limited in the invention. For example, the tunable antenna module 100 may include 2, 3, 4, 5 or more impedance elements. The switch element 150 selects one of the impedance elements 161 and 162 according to a control signal, such that the second radiation metal element 140 is coupled through the selected impedance element to the ground voltage VSS. For example, the aforementioned control signal may be generated according to a user's input. On the other hand, the switch element 150, and the impedance elements 161 and 162, and the signal source 190 may all be disposed on the ground metal plane 110. By using the switch element 150 and the impedance elements 161 and 162, the tunable antenna module 100 with a minimized size can still support multiband operations, and it can provide good radiation performance without designing any clearance region on the ground metal plane 110. That is, the ground metal plane 110 can be a solid metal plane, and there is not any non-metal clearance region hollowed in the ground metal plane 110.

The following embodiments will introduce the detailed structure features of the tunable antenna module 100. It should be understood that these figures and descriptions are merely exemplary, rather than limitations of the invention.

Figure 2:
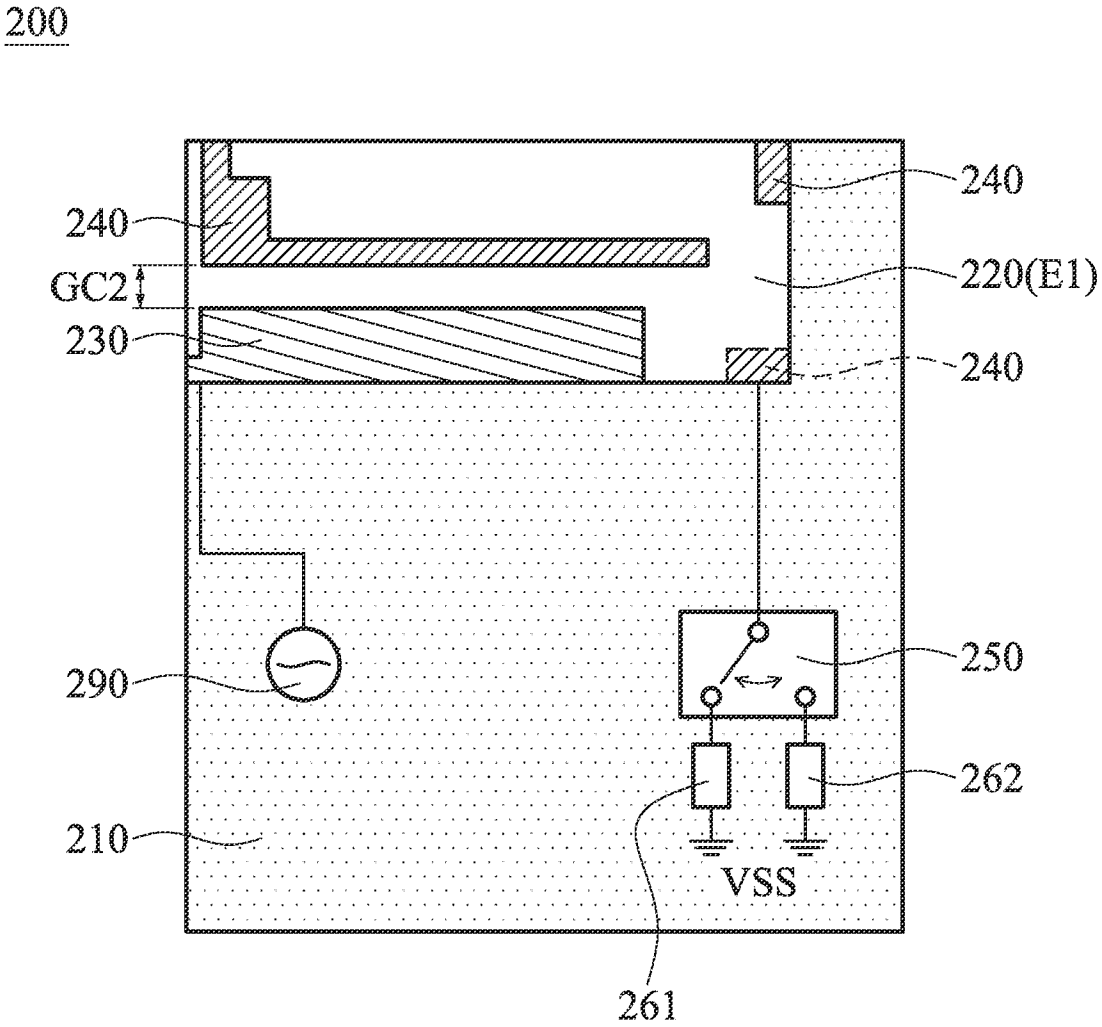
FIG. 2 is a top view of a tunable antenna module according to an embodiment of the invention.
Figure 3:
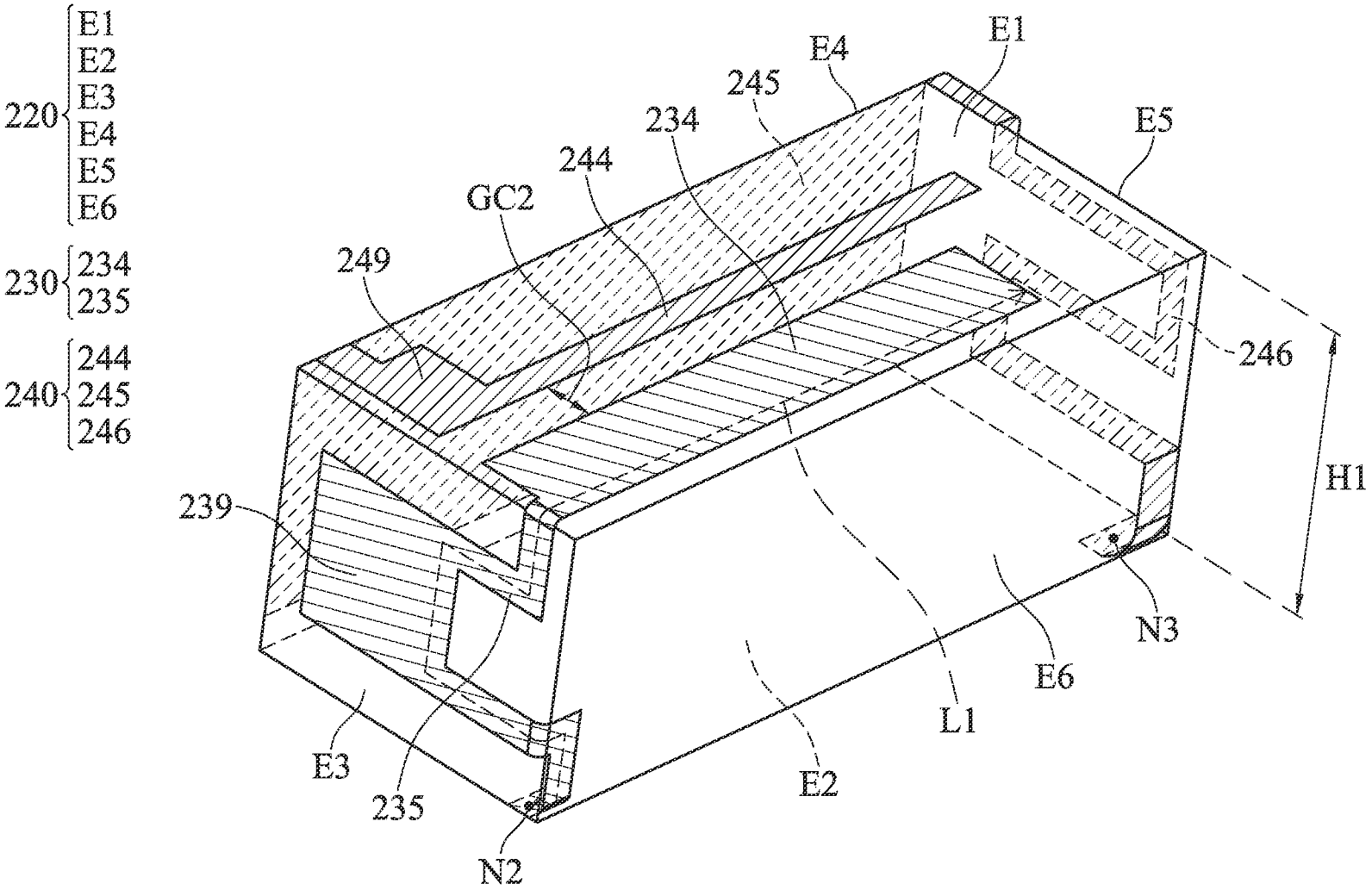
FIG. 3 is a perspective view of a nonconductive support element and a first radiation metal element and a second radiation metal element thereon according to an embodiment of the invention.
Figure 4:
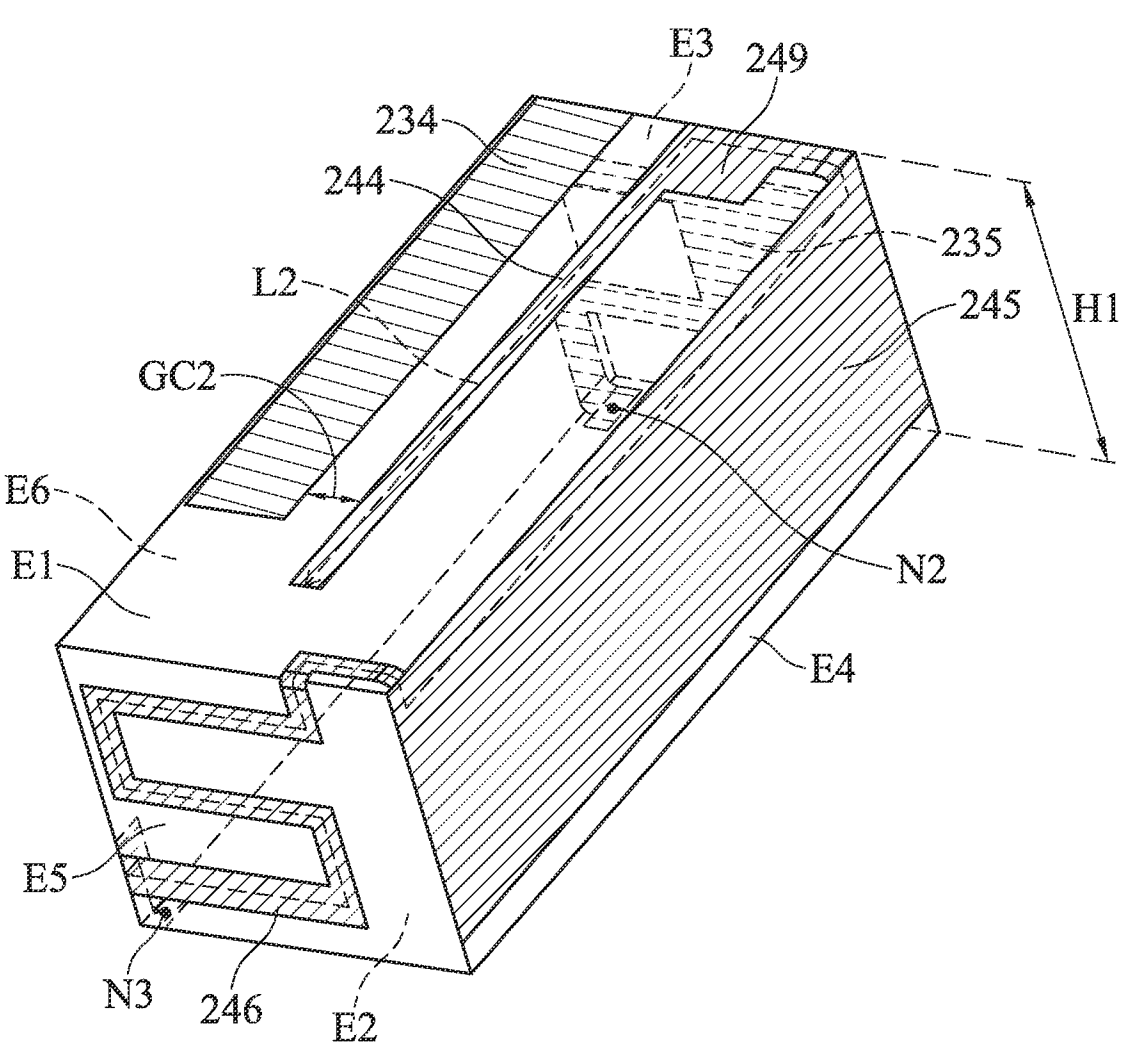
FIG. 4 is a perspective view of a nonconductive support element and a first radiation metal element and a second radiation metal element thereon according to an embodiment of the invention.

FIG. 2 is a top view of a tunable antenna module 200 according to an embodiment of the invention. In the embodiment of FIG. 2, the tunable antenna module 200 at least includes a ground metal plane 210, a nonconductive support element 220, a first radiation metal element 230, a second radiation metal element 240, a switch element 250, a first impedance element 261, and a second impedance element 262. FIG. 3 is a perspective view of the nonconductive support element 220 and the first radiation metal element 230 and the second radiation metal element 240 thereon according to an embodiment of the invention. FIG. 4 is a perspective view of the nonconductive support element 220 and the first radiation metal element 230 and the second radiation metal element 240 thereon (from a different viewing angle) according to an embodiment of the invention. Please refer to FIG. 2, FIG. 3 and FIG. 4 together.

The ground metal plane 210 can provide a ground voltage VSS. The nonconductive support element 220 may be disposed on the ground metal plane 210. Specifically, the nonconductive support element 220 may substantially have a cuboid shape with a first surface E1, a second surface E2, a third surface E3, a fourth surface E4, a fifth surface E5, and a sixth surface E6. The first surface E1 is opposite to the second surface E2. The second surface E2 is adjacent to the ground metal plane 110. The third surface E3, the fourth surface E4, the fifth surface E5, and the sixth surface E6 are all positioned between the first surface E1 and the second surface E2. It should be noted that the term "adjacent" or "close" throughout the disclosure means that the distance (or the space) between two corresponding elements is shorter than a predetermined distance (e.g., 5 mm or less), or it means that the two corresponding elements contact each other directly (i.e., the aforementioned distance or space between them is reduced to 0).

The first radiation metal element 230 includes a first coupling portion 234 and a first connection portion 235. The first coupling portion 234 is coupled through the first connection portion 235 to a signal source 290. The first coupling portion 234 of the first radiation metal element 230 may substantially have a straight-line shape, and may be disposed on the first surface E1 of the nonconductive support element 220. The first connection portion 235 of the first radiation metal element 230 may substantially have a U-shape, and may be disposed on the third surface E3 of the nonconductive support element 220. In some embodiments, the first connection portion 235 of the first radiation metal element 230 further includes a central widening segment 239, which may substantially have a relatively large square shape.

The second radiation metal element 240 includes a second coupling portion 244, a second connection portion 245, and a meandering portion 246. The second coupling portion 244 is coupled through the second connection portion 245 and the meandering portion 246 to the switch element 250. The second coupling portion 244 of the second radiation metal element 240 may substantially have an L-shape, and may be disposed on the first surface E1 of the nonconductive support element 220. A coupling gap GC2 may be formed between the first coupling portion 234 of the first radiation metal element 230 and the second coupling portion 244 of the second radiation metal element 240, such that the second radiation metal element 240 can be excited by the first radiation metal element 230 using a coupling mechanism. In some embodiments, the second coupling portion 244 of the second radiation metal element 240 further includes a corner widening segment 249, which may substantially have a relatively small square shape. The second connection portion 245 of the second radiation metal element 240 may substantially have a rectangular shape, and may be disposed on the fourth surface E4 of the nonconductive support element 220. In some embodiments, the second connection portion 245 of the second radiation metal element 240 almost covers the whole fourth surface E4 of the nonconductive support element 220. The meandering portion 246 of the second radiation metal element 240 may substantially have an S-shape, and may be disposed on the fifth surface E5 of the nonconductive support element 220. In some embodiments, there is almost no metal element disposed on the sixth surface E6 of the nonconductive support element 220.

The first impedance element 261 and the second impedance element 262 have different impedance values. The switch element 250 can select either the first impedance element 261 or the second impedance element 262 according to a control signal, such that the meandering portion 246 of the second radiation metal element 240 is coupled through the selected impedance element to the ground voltage VSS.

According to practical measurements, the tunable antenna module 200 can cover a first frequency band, a second frequency band, and a third frequency band. For example, the first frequency band may be from 699 MHz to 894 MHz, the second frequency band may be around 1575 MHz, and the third frequency band may be from 1710 MHz to 2155 MHz. Therefore, the tunable antenna module 200 can support at least the wideband operations of GPS (Global Positioning System) and LTE (Long Term Evolution).

In some embodiments, the operation principles of the tunable antenna module 200 are described as follows. The first radiation metal element 230 is excited to generate the second frequency band and the third frequency band. The second radiation metal element 240 is excited to generate the first frequency band. If the impedance element selected by the switch element 250 has a relatively large capacitance or inductance, the first frequency band of the tunable antenna module 200 will become lower. Conversely, if the impedance element selected by the switch element 250 has a relatively small capacitance or inductance, the first frequency band of the tunable antenna module 200 will become higher. It should be noted that the total size of the tunable antenna module 200 can be minimized by distributing the first radiation metal element 230 and the second radiation metal element 240 over different surfaces of the nonconductive support element 220. According to practical measurements, when the second connection portion 245 of the second radiation metal element 240 covers almost the entire fourth surface E4 of the nonconductive support element 220 (e.g., the fourth surface E4 may be arranged toward an exterior side or an air side), the radiation efficiency of the tunable radiation element 200 is significantly increased in the first frequency band because the corresponding resonant path is not affected so much by adjacent circuitry. In addition, the incorporation of the central widening segment 239 and the corner widening segment 249 can provide additional current paths, thereby improving the operation bandwidths of the first frequency band, the second frequency band, and the third frequency band of the tunable antenna module 200.

In some embodiments, the element sizes of the tunable antenna module 200 are described as follows. The length L1 of the first radiation metal element 230 (i.e., the total length L1 of the first coupling portion 234 and the first connection portion 235) may be shorter than or equal to 0.25 wavelength (λ/4) of the second frequency band of the tunable antenna module 200. The length L2 of the second radiation metal element 240 (i.e., the total length L2 of the second coupling portion 244, the second connection portion 245, and the meandering portion 246) may be shorter than or equal to 0.25 wavelength (λ/4) of the lowest frequency of the first frequency band of the tunable antenna module 200. The width of the coupling gap GC2 may be shorter than or equal to 3 mm. The total height H1 of the nonconductive support element 220 on the ground metal plane 210 may be at least 9 mm. The above ranges of element sizes are calculated and obtained according to many experiment results, and they help to optimize the operation bandwidth and impedance matching of the tunable antenna module 200. It should be noted that if any dielectric material is used for the tunable antenna module 200, each wavelength as described above should be adjusted to an effective wavelength in response to a dielectric constant of such a dielectric material.

Figure 5:
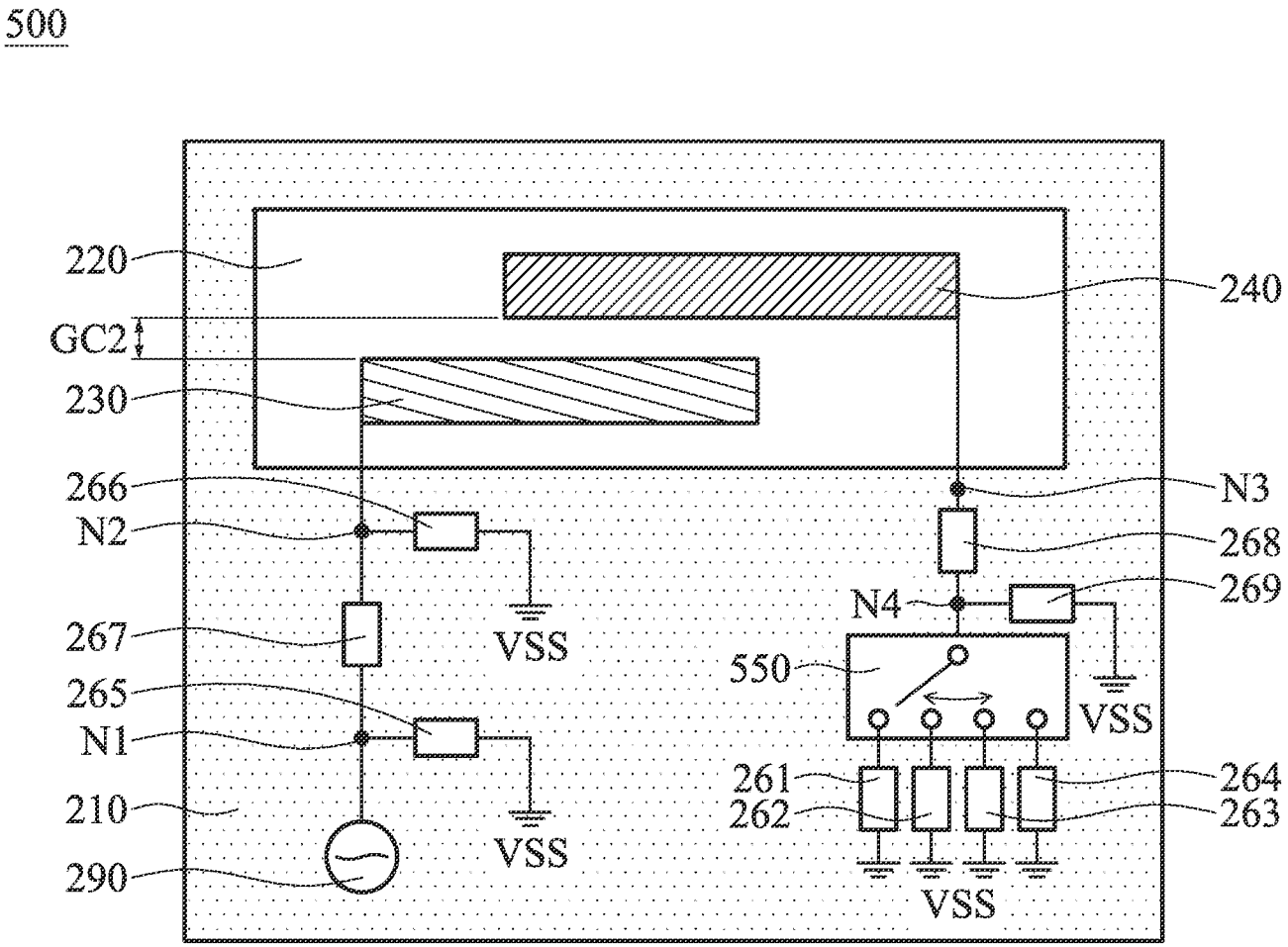
FIG. 5 is a diagram of a tunable antenna module according to an embodiment of the invention.

FIG. 5 is a diagram of a tunable antenna module 500 according to an embodiment of the invention. FIG. 5 is similar to FIGS. 1 to 4. Please refer to FIGS. 1 to 5 together. In the embodiment of FIG. 5, besides the first impedance element 261 and the second impedance element 262, the tunable antenna module 500 further includes a third impedance element 263, a fourth impedance element 264, a fifth impedance element 265, a sixth impedance element 266, a seventh impedance element 267, an eighth impedance element 268, and a ninth impedance element 269. The first impedance element 261, the second impedance element 262, the third impedance element 263, and the fourth impedance element 264 have different impedances values. For example, each of the first impedance element 261, the second impedance element 262, and the third impedance element 263 may be a capacitor, and the fourth impedance element 264 may be a resistor, but they are not limited thereto. A switch element 550 of the tunable antenna module 500 can select one of the first impedance element 261, the second impedance element 262, the third impedance element 263, and the fourth impedance element 264 according to a control signal, such that the meandering portion 246 of the second radiation metal element 240 is coupled through the selected impedance element to the ground voltage VSS. The fifth impedance element 265, the sixth impedance element 266, and the seventh impedance element 267 are configured to fine-tune the impedance matching of the first radiation metal element 230. Specifically, the fifth impedance element 265 is coupled between a first node N1 and the ground voltage VSS. The first node N1 is further coupled to the signal source 290. The sixth impedance element 266 is coupled between a second node N2 and the ground voltage VSS. The second node N2 is further coupled to the first connection portion 235 of the first radiation metal element 230 (referring to FIG. 3). The seventh impedance element 237 is coupled between the first node N1 and the second node N2. For example, each of the fifth impedance element 235 and the sixth impedance element 236 may be a capacitor, and the seventh impedance element 237 may be a short-circuited path or an inductor, but they are not limited thereto. The eighth impedance element 268 and the ninth impedance element 269 are configured to fine-tune the impedance matching of the second radiation metal element 240. Specifically, the eighth impedance element 268 is coupled between a third node N3 and a fourth node N4. The third node N3 is further coupled to the meandering portion 246 of the second radiation metal element 240 (referring to FIG. 4). The ninth impedance element 269 is coupled between the fourth node N4 and the ground voltage VSS. The fourth node N4 is further coupled to the switch element 550. Specifically, a terminal of the switch element 550 is coupled to the fourth node N4, and another terminal of the switch element 550 is switchable between the first impedance element 261, the second impedance element 262, the third impedance element 263, and the fourth impedance element 264. For example, any of the eighth impedance element 268 and the ninth impedance element 269 may be a short-circuited path, a capacitor, or an inductor (whose inductance may be smaller than or equal to 76 nH), but it is not limited thereto. According to practical measurements, the operation bandwidth and the impedance matching of the tunable antenna module 500 can be improved by further incorporating the third impedance element 263, the fourth impedance element 264, the fifth impedance element 265, the sixth impedance element 266, the seventh impedance element 267, the eighth impedance element 268, and the ninth impedance element 269. Other features of the tunable antenna module 500 are similar to those of the tunable antenna module 100 of FIG. 1 and those of the tunable antenna module 200 of FIGS. 2 to 4. Accordingly, these embodiments can achieve similar levels of performance.

The invention proposes a novel tunable antenna module. In comparison to the conventional design, the invention has at least the advantages of small size, wide bandwidth, and no clearance region on a ground metal plane, and therefore it is suitable for application in a variety of communication devices.

Note that the above element sizes, element shapes, element parameters, and frequency ranges are not limitations of the invention. An antenna designer can fine-tune these settings or values according to different requirements. It should be understood that the tunable antenna module of the invention is not limited to the configurations of FIGS. 1-5. The invention may merely include any one or more features of any one or more embodiments of FIGS. 1-5. In other words, not all of the features displayed in the figures should be implemented in the tunable antenna module of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A tunable antenna module, comprising: a ground metal plane, providing a ground voltage; a nonconductive support element; a first radiation metal element, coupled to a signal source; a second radiation metal element, disposed adjacent to the first radiation metal element, and separated from the first radiation metal element; a plurality of impedance elements; and a switch element, selecting one of the impedance elements, such that the second radiation metal element is coupled through the selected impedance element to the ground voltage; wherein the nonconductive support element has a 3D (Three-Dimensional) structure, and the first radiation metal element and the second radiation metal element are distributed over the nonconductive support element; wherein the first radiation metal element comprises a first coupling portion and a first connection portion, and the first coupling portion is coupled through the first connection portion to the signal source; wherein the first connection portion further comprises a central widening segment; wherein the central widening segment and the first coupling portion are respectively disposed on two different planes which are substantially perpendicular to each other; wherein the nonconductive support element substantially has a cuboid shape with a first surface, a second surface, a third surface, a fourth surface, a fifth surface and a sixth surface, wherein the first surface is opposite to the second surface, wherein the second surface is adjacent to the ground metal plane, and wherein the third surface, the fourth surface, the fifth surface and the sixth surface are positioned between the first surface and the second surface; wherein the tunable antenna module further comprises: a fifth impedance element, coupled between a first node and the ground voltage, wherein the first node is further coupled to the signal source; a sixth impedance element, coupled between a second node and the ground voltage, wherein the second node is further coupled to the first connection portion of the first radiation metal element; a seventh impedance element, coupled between the first node and the second node; an eighth impedance element, coupled between a third node and a fourth node, wherein the third node is further coupled to a meandering portion of the second radiation metal element; and a ninth impedance element, coupled between the fourth node and the ground voltage, wherein the fourth node is further coupled to the switch element; wherein each of the fifth impedance element and the sixth impedance element is a capacitor, and the seventh impedance element is a short-circuited path or an inductor.

2. The tunable antenna module as claimed in claim 1, wherein the first coupling portion of the first radiation metal element substantially has a straight-line shape, and is disposed on the first surface of the nonconductive support element.

3. The tunable antenna module as claimed in claim 1, wherein the first connection portion of the first radiation metal element substantially has a U-shape, and is disposed on the third surface of the nonconductive support element.

4. The tunable antenna module as claimed in claim 1, wherein the second radiation metal element comprises a second coupling portion, a second connection portion, and a meandering portion, and the second coupling portion is coupled through the second connection portion and the meandering portion to the switch element.

5. The tunable antenna module as claimed in claim 4, wherein the second coupling portion of the second radiation metal element substantially has an L-shape, and is disposed on the first surface of the nonconductive support element.

6. The tunable antenna module as claimed in claim 4, wherein the second connection portion of the second radiation metal element substantially has a rectangular shape, and is disposed on the fourth surface of the nonconductive support element.

7. The tunable antenna module as claimed in claim 4, wherein the second connection portion of the second radiation metal element almost covers the whole fourth surface of the nonconductive support element.

8. The tunable antenna module as claimed in claim 4, wherein the fourth surface of the nonconductive support element is arranged toward an external side or an air side.

9. The tunable antenna module as claimed in claim 4, wherein the meandering portion of the second radiation metal element substantially has an S-shape, and is disposed on the fifth surface of the nonconductive support element.

10. The tunable antenna module as claimed in claim 4, wherein a coupling gap is formed between the first coupling portion of the first radiation metal element and the second coupling portion of the second radiation metal element, and a width of the coupling gap is shorter than or equal to 3 mm.

11. The tunable antenna module as claimed in claim 1, wherein the tunable antenna module covers a first frequency band from 699 MHz to 894 MHz, a second frequency band around 1575 MHz, and a third frequency band from 1710 MHz to 2155 MHz, wherein a length of the first radiation metal element is shorter than or equal to 0.25 wavelength of the second frequency band, and wherein a length of the second radiation metal element is shorter than or equal to 0.25 wavelength of the lowest frequency of the first frequency band.

12. The tunable antenna module as claimed in claim 1, wherein the impedance elements comprises a first impedance element, a second impedance element, a third impedance element and a fourth impedance element, wherein each of the first impedance element, the second impedance element and the third impedance element is a capacitor, and wherein the fourth impedance element is a resistor.

13. The tunable antenna module as claimed in claim 1, wherein any of the eighth impedance element and the ninth impedance element is a short-circuited path, a capacitor, or an inductor.

14. The tunable antenna module as claimed in claim 1, wherein there is no clearance region designed on the ground metal plane.

15. The tunable antenna module as claimed in claim 1, wherein a total height of the nonconductive support element on the ground metal plane is at least 9 mm.

* * * * *